US006491023B1

(12) United States Patent
Lippa

(10) Patent No.: US 6,491,023 B1
(45) Date of Patent: Dec. 10, 2002

(54) ELECTRONIC THROTTLE SYSTEM

(75) Inventor: Allan J. Lippa, Northville, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/167,873

(22) Filed: Jun. 13, 2002

Related U.S. Application Data

(63) Continuation of application No. 09/792,346, filed on Feb. 24, 2001, now Pat. No. 6,463,797.
(60) Provisional application No. 60/184,946, filed on Feb. 25, 2000.

(51) Int. Cl.[7] ..... F02D 9/08
(52) U.S. Cl. ..... 123/399; 73/118.2
(58) Field of Search ..... 123/361, 399; 73/118.2

(56) References Cited

U.S. PATENT DOCUMENTS 2,938,184 A * 5/1960 Mayer ..... 338/89
4,526,042 A * 7/1985 Yamazoe et al. ..... 73/118.1
4,693,111 A * 9/1987 Arnold et al. ..... 338/120
4,718,272 A * 1/1988 Plapp ..... 73/118.1
4,901,695 A * 2/1990 Kabasin et al. ..... 123/399
5,136,880 A * 8/1992 Norgauer ..... 73/117.3
5,452,697 A * 9/1995 Sasaki et al. ..... 123/361
5,566,656 A * 10/1996 Buchl ..... 123/399
6,237,564 B1 * 5/2001 Lippa et al. ..... 123/361

* cited by examiner

*Primary Examiner*—Erick Solis
(74) *Attorney, Agent, or Firm*—Allan J. Lippa; John D. Russell

(57) ABSTRACT

An electronic throttle control system is described where a throttle position sensor has multiple slopes depending on the operating region. At low throttle positions, a greater slope, and thus a greater sensitivity is provided, thereby increasing control resolution. At greater throttle positions, a lower slope, and thus lower sensitivity is provided. In this way, an output signal that varies across the entire operating region of the throttle is provided for monitoring and control, while improved performance at low throttle angles can be simultaneously achieved. A method of making the sensor is also described.

1 Claim, 4 Drawing Sheets

ELECTRONIC THROTTLE SYSTEM

This application is a continuation application of U.S. Ser. No. 09/792,346, filed Feb. 24, 2001 now U.S. Pat. No. 6,463,797, having the same assignee as the present application, and which is incorporated herein in its entirety by reference.

This application claims the benefit of U.S. Provisional No. 60/184,946, filed Feb. 25, 2000, titled "ELECTRONIC THROTTLE SYSTEM".

FIELD OF THE INVENTION

The field of the invention relates to electronically controlled throttle units in vehicles having a drive unit.

BACKGROUND OF THE INVENTION

In some engines, an electronically controlled throttle is used for improved performance. In such systems, position of the throttle is controlled via closed loop feedback control. Typically, to provide redundancy multiple throttle position sensors are provided.

One method to provide two throttle position sensors uses sensors of different gradients, each linear over the entire operating range, another uses gradients of opposite sign. Still other methods use saturating sensors. These methods are described U.S. Pat. Nos. 5,136,880, 5,260,877, and 4,693,111, respectively.

The inventors herein have recognized some disadvantages of the above approaches. In particular, when a high resolution saturating sensor and a low resolution sensor are used together, there is a saturated region where the saturating sensor provides less information than the unsaturated region. Alternatively, when different gradients are used, each linear over the entire region, the analog to digital converters are over-specified and under-utilized to accommodate the low resolution sensor. Another disadvantage with prior approaches is that multiple tracks, interconnections between the tracks, and wiper arms may be required to provide multiple outputs having different characteristics.

SUMMARY OF THE INVENTION

An object of the present invention is to provide electronic throttle control systems and sensors.

The above object is achieved and disadvantages of prior approaches overcome by a position sensor according to the present invention. In one aspect, the sensor comprises a substrate, and a track positioned on said substrate including at least two contiguous first and second segments, each of said segments having a different material property.

By having a sensor with two operating regions, it is possible to obtain high resolution at low throttle angles, and thereby have better airflow control as well as to obtain information throughout the operating range without over-specifying and under-utilizing A/D converters.

An advantage of the above aspect of the invention is improved monitoring.

Another advantage of the above aspect of the invention is improved control.

In another aspect of the present invention, the sensor further comprises a single movable wiper for sliding over said track to provide an electrical signal having an amplitude related to position of said wiper.

An advantage of the above aspect of the present invention is that a simplified structure is provided with a single track having two segments, no interconnection between the segments, and only a single wiper arm moving across both segments.

BRIEF DESCRIPTION OF THE DRAWINGS

The object and advantages of the invention claimed herein will be more readily understood by reading an example of an embodiment in which the invention is used to advantage with reference to the following drawings wherein:

DESCRIPTION OF THE INVENTION

Figure 1:
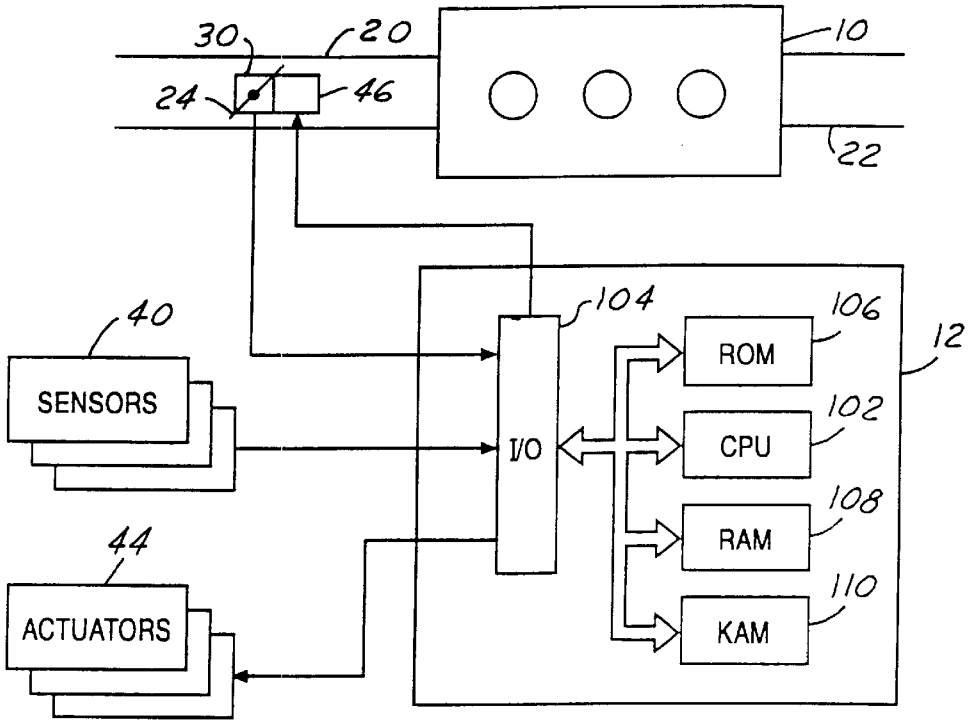
FIG. 1 is a block diagram of a vehicle illustrating various components related to the present invention.

Internal combustion engine 10, comprising a plurality of cylinders, is controlled by electronic engine controller 12. Engine 10 can be a port fuel injected engine, a directed injected engine, a gasoline engine, a diesel engine, or any other type of engine utilizing redundant position sensors. Engine 10 is coupled to intake 20 and exhaust 22. A throttle 24 is positioned in intake 20. Position sensor 30, described. later herein with particular reference to FIG. 2, is coupled to throttle 24.

Controller 12 is shown in FIG. 1 as a conventional microcomputer including: microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors 40 coupled to engine 10, in addition to signals from position sensor 30. Controller 12 is also shown sending various signals to actuators 44 coupled to engine 10. Additionally, an electric motor 46 is coupled to throttle 24 and receives a control signal from controller 12 to control position of throttle 44, as well as engine torque, or vehicle acceleration.

Figure 2A:
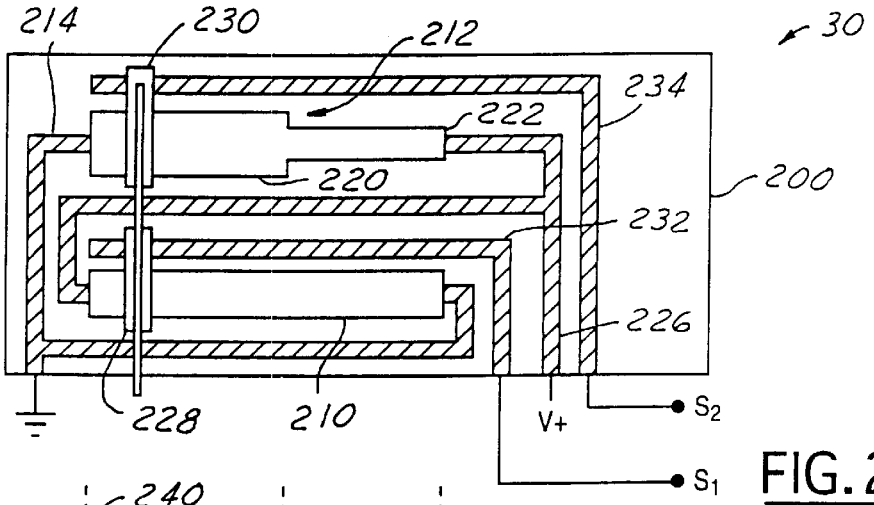
FIG. 2*a* is a schematic diagram of the position sensor.

Referring now to FIG. 2, and in particular to FIG. 2*a,* position sensor 30 is shown. In this particular depiction, position sensor 30 is shown as an unrolled version of a rotary (angular) sensor. Those skilled in the art will recognize, in. view of this disclosure, that the present invention is applicable to angular position sensors for measuring angular deflection as will as displacement position sensors for measuring deflection in a uniform direction, i.e., along a line.

Sensor 30 has substrate 200, which supports tracks 210 and 212. First track 210 and second track 212 are tracks of resistive material that are used to produce two potentiometer signals (S1, S2). Additional tracks can be placed on substrate 200 without departing from the present invention. Second track 212 has two contiguous segments, first segment 220 and a second segment 222. Track 212 is produced by applying the first track segment of a first resistivity on the substrate, and applying, contiguous to said first track segment, a second track segment having a second resistivity on the substrate. Conductive path 214 supplies a grounded, or low voltage signal to first segment 220 of track 212. Conductive path 214 also supplies a grounded, or low voltage signal, to an opposite end of track 210 as that of track 212. Conductive path 226 supplies a supply voltage signal to second segment 222 of track 212, as well as, to an opposite end of track 210 as that of track 212. Wipers 228 and 230 provide signals S1 and S2 to conductive paths 232 and 234 respectively. First and second segment of track 212 have different material properties. In particular, they provide different resistivities. In the embodiment depicted in FIG. 2*a,* the different resistivities are provided by different track widths. Those skilled in the art will recognize, in view of this disclosure, various other methods of having two segments, each with different resistivities.

Figure 2B:
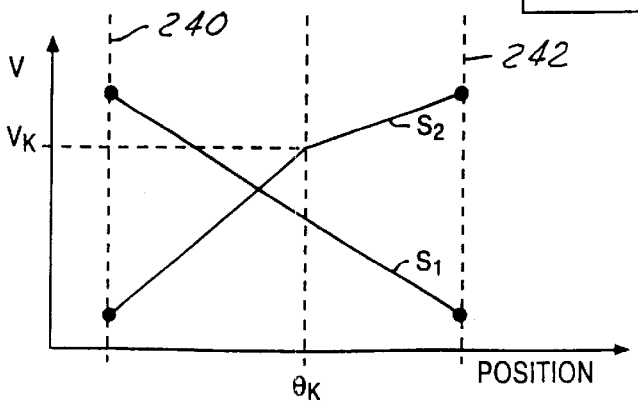
FIGS. 2*b* and 4 are graphs showing output characteristics of the sensor.

Referring now to FIG. 2*b,* a graph showing the output voltage characteristics of sensor 30 are shown versus wiper position. θk identifies the point where the two segments of track 212 transition. This region may be a sharp point, as illustrated in FIG. 2*b,* or might have some curvature, and thus there would be a transition region, the size of which depends on the manufacturing process chosen to produce the two segments.

Continuing with FIG. 2*b,* opposite polarity of signals S1 and S2 is obtained by conductive paths 214 and 226 being connected to opposite ends of tracks 212 and 210. Similarly, the two linear segments of signal S2, each having a different slope, are obtained by having two segments (220, 222) of track 212, each having a different resistivity. Lines 240 and 242 represent the closed stop and open stop of throttle 24.

Figure 3:
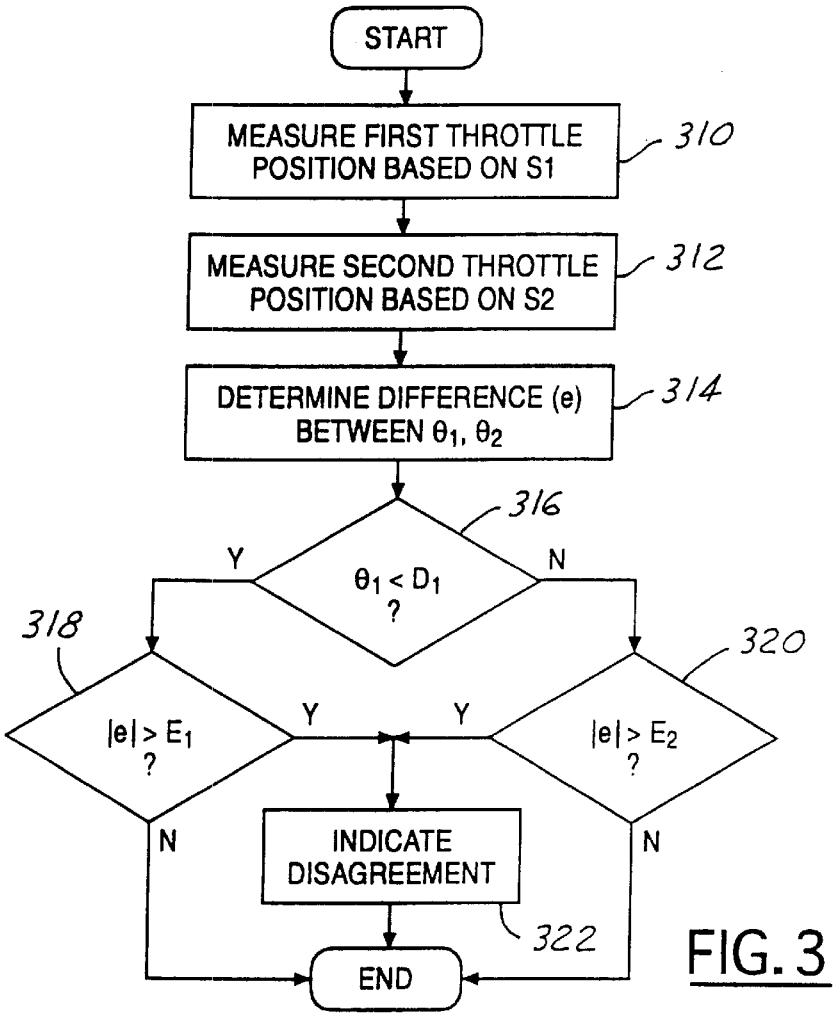
FIGS. 3, 5, and 6 are block diagrams of embodiments in which the invention is used to advantage.

Referring now to FIG. 3, a routine is shown for determining whether output signals S1 and S2 of sensor 30 are in agreement. First, in step 310, first throttle position ($\theta_1$) is determined based on signal S1 and the characteristics, or resistance, of track 210. In particular, as described later herein, first throttle position is determined based on a slope and offset of signal S1. Next, in step 312, second throttle position ($\theta_2$) is measured and determined based on signal S2. In particular, the characteristics of track 212 are used. As described later herein, when measured voltage signal (S1) is less than a predetermined value, a first slope and first offset are used to convert signal S2 to $\theta_2$. When the voltage is greater than said level, a second slope and offset are used to convert signal S2 to $\theta_2$. Next, in step 314, a difference (e) is determined between first throttle position and second throttle position. In step 316, a determination is made as to whether first throttle position is less than a predetermined value D1. In other words, a determination is made in step 316 as to whether the throttle is operating in the region of the first segment of track 212 or in the region of the second segment of track 212. When the answer to step 316 is YES, a determination is made in step 318 as to whether the absolute value of the difference between the first and second throttle positions is greater than the threshold value E1. Otherwise, when the answer to step 316 is NO, a determination is made as to whether the absolute value of the difference is greater than threshold value E2. According to the present invention, different threshold levels are used depending on whether the throttle is operating in the first segment or second segment of track 212. In other words, since the signals have different sensitivity and resolution, different threshold values are used to account for this. In this way, it is possible to obtain higher sensitivity to disagreement in regions of low throttle position where a small change in throttle position produces a large change in engine torque, and lesser resolution in regions a large change of throttle position produces only a small change in engine torque. When the answer to either step 318 or 320 is YES, disagreement is indicated in step 322.

Figure 4:
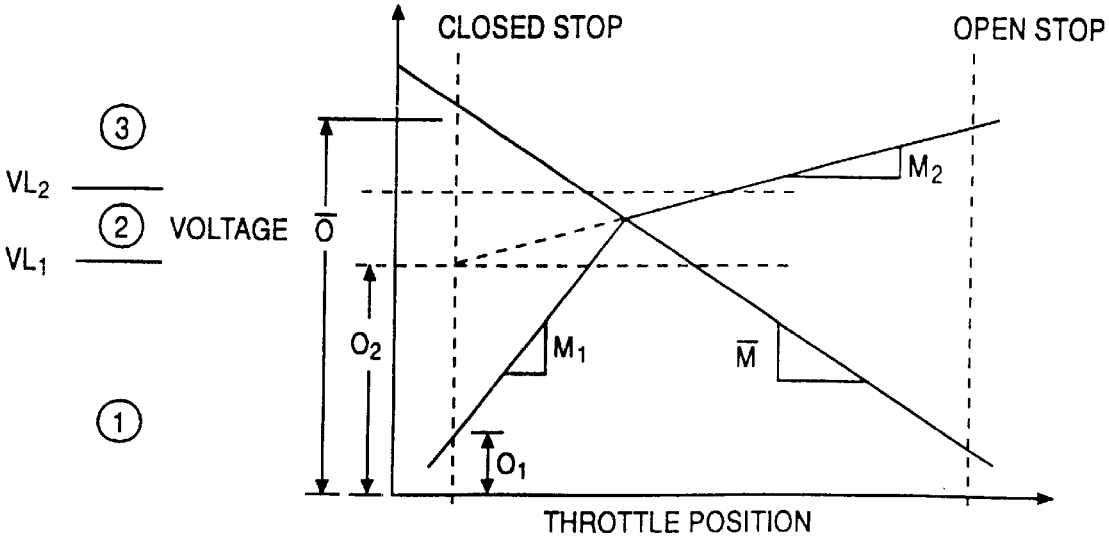

Referring now to FIG. 4, a detailed graph showing the output characteristics of sensor 30 is shown. In particular, slope m1 and offset o1 are shown for the first segment of track 212, second slope m2 and second offset o2 are shown for the second segment of track 212. Also, slope $\overline{m}$, and offset $\overline{o}$, are shown for track 210. Three regions (circled 1, 2, and 3) are shown on the left-hand side of FIG. 4. Region 2 represents the region of the transition between the first and second segments of track 212. Voltage levels VL1 and VL2 define region 2. Voltage levels VL1 and VL2 are predetermined values that represent physically determined limits due to manufacturing tolerance between which the transition resides. In addition, vertical dash lines show the close stop and open stop positions.

The following equations show how signals S1 and S2 are converted to throttle positions using the slopes and offsets.

$$\theta_1 = \frac{S1 - \overline{o}}{\overline{m}}$$

$$\theta_2 = \frac{S2 - o_1}{m_1}$$

$$\theta_2 = \frac{S2 - o_2}{m_2}$$

Figure 5:
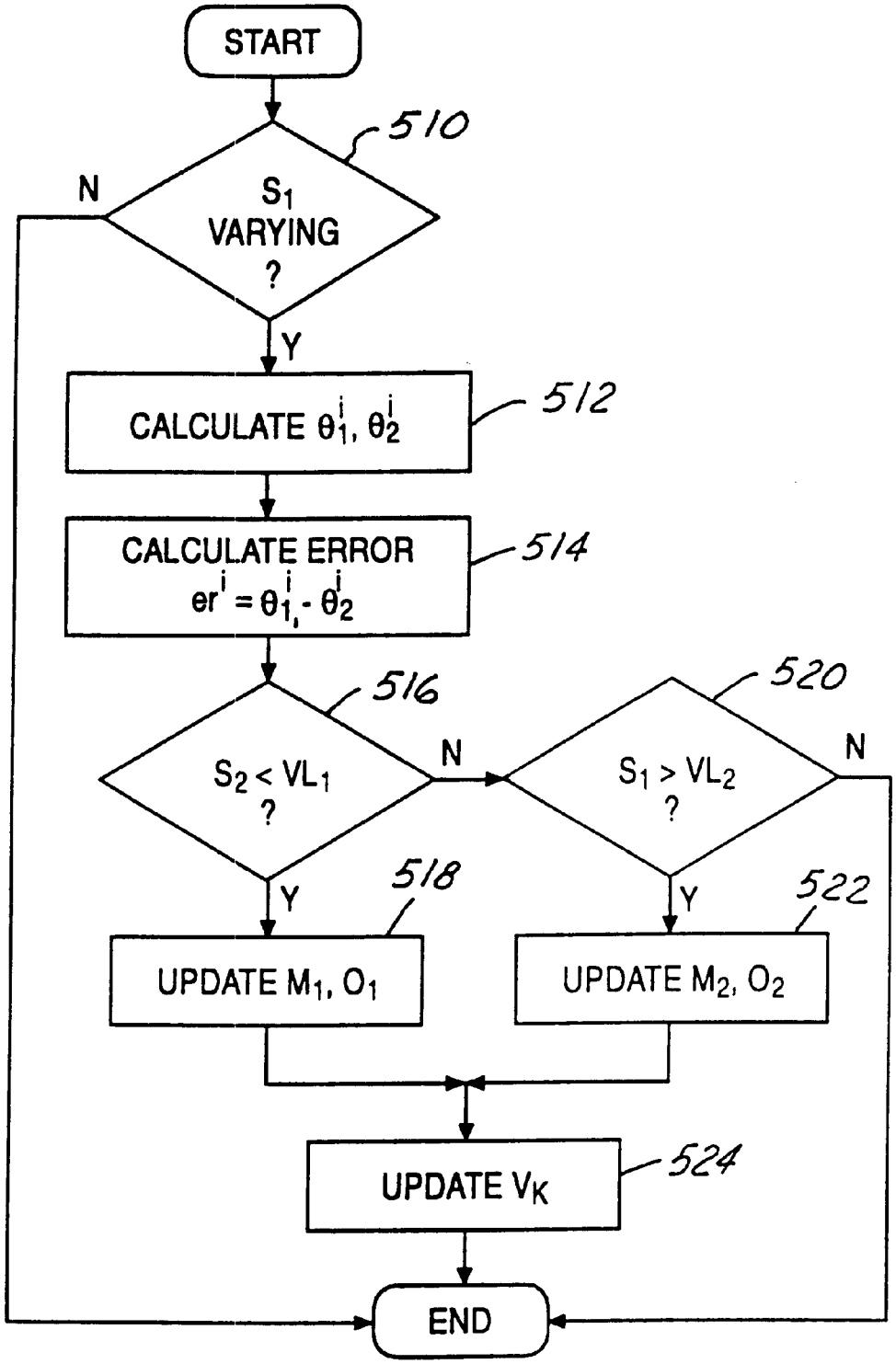

Referring now to FIG. 5, a routine is described for learning the region of the transition between first and second segments of track 212. First, in step 510, a determination is made as to whether first signal S1 is varying. In other words, when learning both a slope and an offset from the given information, improved accuracy can be obtained if what is known as "persistence of excitation" to those skilled in the art is present. If only the offset is learned of signal S2 in the upper region, step 510 can be deleted. When the answer to step 510 is YES, the routine continues to step 512 and calculates the current measurement at step i of first and second throttle positions ($\theta_1^i$, $\theta_2^i$). Next, in step 514, the current value of the error signal ($er^i$) is calculated based on the measured throttle position as shown:

$$er^i = \theta_1^i - \theta_2^i$$

Next, in step 516, a determination is made as to whether first voltage signal S1 is less than voltage limit VL1. When the answer to step 516 is YES, the routine continues to step 518 where the routine updates first slope and first offset (m1, o1). The following equations describe the updating of learning of the slope and the offset of the first segment of track 212:

$$m_1^{i+1} = f(er^i, m_1^i, o_1^i, \theta_1^i)$$

$$o_1^{i+1} = g(er^i, m_1^i, o_1^i, \theta_1^i)$$

In a preferred embodiment, functions f,g represent a recursive least squares algorithm. However, those skilled in the art will recognize, in view of this disclosure, that various other algorithms can be used drive error signal (er) to zero or to a minimum by adjusting the slopes and offsets. For example, a learning algorithm,. of the type described in U.S. Pat. No. 5,464,000, could be adapted to cooperate with the present invention.

Otherwise, when the answer to step 516 is NO, a determination is made in step 520 as to whether first voltage signal S1 is greater than voltage limit 2. When the answer to step 520 is YES, the routine updates or learns the second slope and offset (m2, o2), in step 522:

$$m_2^{i+1} = f(er^i, m_2^i, o_2^i, \theta_1^i)$$

$$o_2^{i+1} = g(er^i, m_2^i, o_2^i, \theta_1^i)$$

From either step 518 or 522, the routine continues to step 524 and updates transition voltage Vk. Transition voltage Vk is calculated according to the following equation:

$$V_k = m_1 \frac{o_2 - o_1}{m_1 - m_2} + o_1$$

Thus, according to the present invention, it is possible to learn the region of the transition based on measurements of the first and second sensor. In this way, it is possible to use signal S2 for feedback control with high accuracy, despite the presence of the transition as described in FIG. 6.

Figure 6:
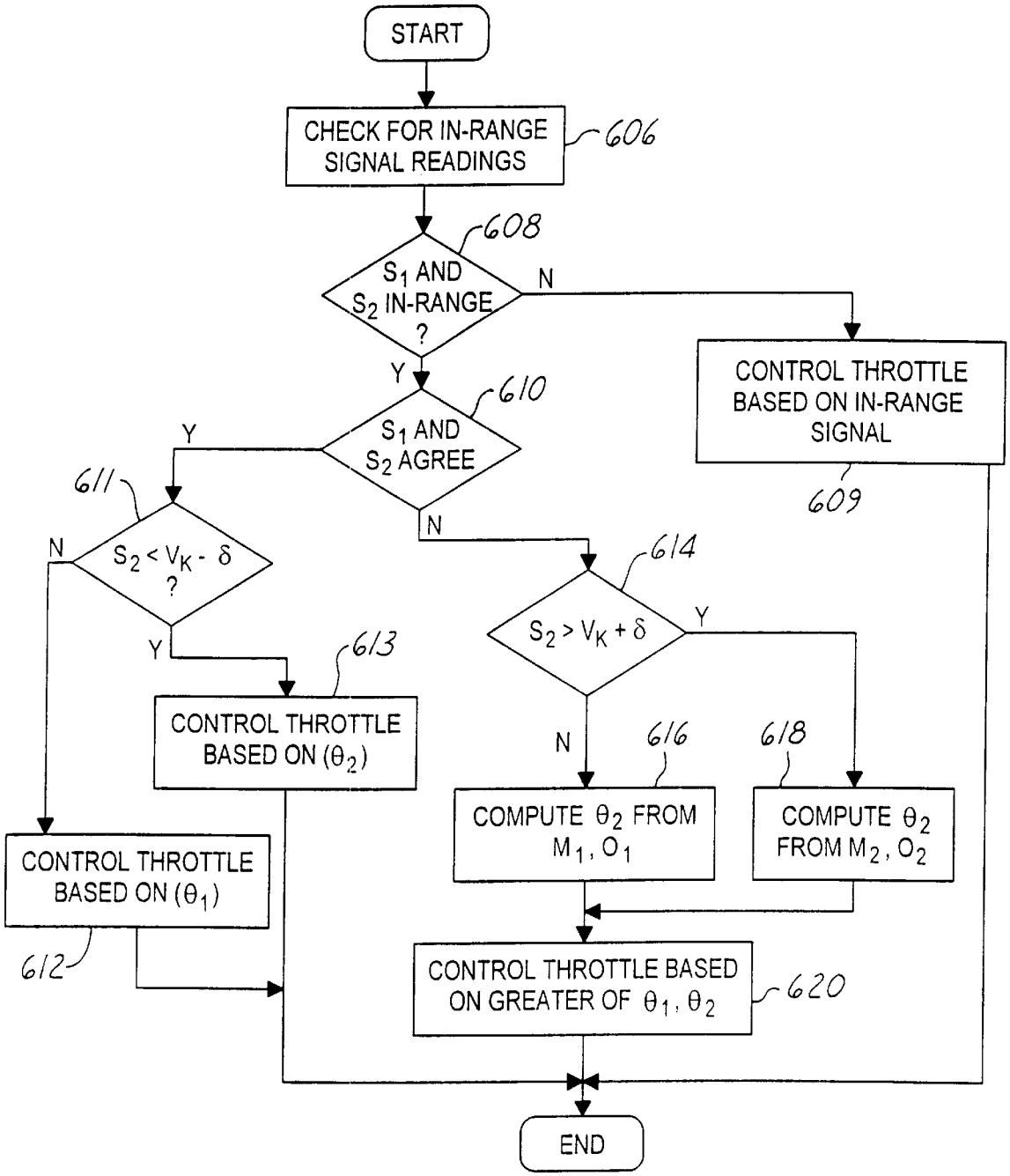

Referring now to FIG. 6, a routine is described for controlling throttle 24. First, in step 606, a check for in-range signal readings is made. Then, in step 608, a determination is made as to whether both signals S1 and S2 are in-range. When the answer to step 608 is YES, the routine continues to step 610. Otherwise, the routine continues to step 609, where the throttle is controlled based on whichever signal is in range. Next, in step 610, a check is made as to whether, in-range disagreement is indicated in step 322. When agreement is indicated in step 610, the routine continues to step 611 where a determination is made as to whether signal S2 is less that voltage Vk minus tolerance amount (γ). When the answer to step 611 is YES, the routine continues to step 612 and controls throttle position based on first throttle position (θ1), which is based on signal S1. When the answer to step 612 is NO, the routine continues to step 613 and controls throttle position based on second throttle position (θ2), which is based on signal S2. In this way, increased control resolution can be obtained by using the sensor with the greater absolute value of gradient. In an alternative embodiment, the downward sloping signal can be used, regardless of the determination in step 611, as the default to provide closed loop feedback control of throttle position.

When the answer to step 610 is NO, the routine continues to step 614, where a determination is made as to whether signal S2 is greater than learned voltage (Vk) plus a small tolerance value (δ). In particular, in step 610, when sensors 1 and When the answer to step 614 is YES, it is determined that the throttle is operating in the first segment of track 212, and in step 616, second throttle position is calculated from first slope and first offset (m1,o1). Otherwise, when the answer to step 614 is NO, it is determined that the throttle is operating in the second segment of track 212 and second throttle position is calculated from the second slope and second offset (m2, o2). Then, in step 620, throttle position is controlled based on the greater of first throttle position and second throttle positions. In this way, a conservative approach is taken in that the greater of the throttle positions is selected so that feedback control will always tend to close the throttle in the event that one of the sensors indicates an incorrect value.

Because measured throttle position from either track 210 or 212 can be used for feedback control, it is important to know the region of the transition of track 212. In particular, since a system gain is changing, it is important that the correct slope and offset are used. This is also why a positive tolerance is used in step 614 so that the system errs on selecting the greater slope. In other words, if assumed sensor slope and actual sensor slope differ, then the actual system gain will be different than the actual. As described, the present invention selects a positive tolerance, thereby providing a conservative approach since the lower region of throttle position slope is greater than the upper region of throttle position slope. In other words, a tolerance range is given where the greater slope is selected, thereby giving lower system gain in the transition region, which is conservative.

In an alternative embodiment, only offset o2 is learned. In particular, due to the manufacturing process, the location of the transition will mostly affect offset o2. Thus, this parameter alone can be learned and used in the present invention.

Although several examples of embodiments which practice the invention have been described herein, there are numerous other examples which could also be described. The invention is therefore to be defined only in accordance with the following claims.

I claim:

1. An electronic throttle control system, comprising:

a throttle plate;

a first position sensor coupled to said throttle plate;

a second position sensor coupled to said throttle plate;

wherein said second position sensor has a first characteristic in a first operating range and a second characteristic in a second operating rate, wherein said first characteristic provides a greater signal sensitivity than said second characteristic, said first and second characteristic being a first and second slope, said first position sensor having a third slope opposite to said first and second slope.

* * * * *